US010395592B2

(12) United States Patent
Lai et al.

(10) Patent No.: US 10,395,592 B2
(45) Date of Patent: Aug. 27, 2019

(54) PIXEL UNIT STRUCTURE OF ORGANIC LIGHT EMITTING DIODE DISPLAY PANEL AND DRIVING MECHANISM THEREOF

(71) Applicant: HON HAI PRECISION INDUSTRY CO., LTD., New Taipei (TW)

(72) Inventors: Chung-Wen Lai, New Taipei (TW); Sheng-Han Li, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/805,233

(22) Filed: Nov. 7, 2017

(65) Prior Publication Data

US 2018/0090070 A1 Mar. 29, 2018

Related U.S. Application Data

(62) Division of application No. 14/812,546, filed on Jul. 29, 2015, now Pat. No. 9,847,058.

(30) Foreign Application Priority Data

Nov. 26, 2014 (TW) ..... 103141080 A

(51) Int. Cl.
*G09G 3/3233* (2016.01)

(52) U.S. Cl.
CPC ... *G09G 3/3233* (2013.01); *G09G 2300/0861* (2013.01)

(58) Field of Classification Search
CPC ..... G09G 3/3233
USPC ..... 345/82
See application file for complete search history.

(56) References Cited

U.S. PATENT DOCUMENTS

2011/0115835 A1* 5/2011 Lee ..... G09G 3/3233 345/691
2011/0193856 A1* 8/2011 Han ..... G09G 3/3233 345/214
2013/0127815 A1* 5/2013 Yoo ..... G09G 3/3233 345/212

* cited by examiner

*Primary Examiner* — Long D Pham
(74) *Attorney, Agent, or Firm* — ScienBiziP, P.C.

(57) ABSTRACT

A pixel unit structure of an organic light emitting diode display panel includes a switch transistor, a storage capacitor, an organic light emitting diode, a driving transistor, a first control circuit, and a second control circuit. The organic light emitting diode is controlled by the driving transistor and the first control circuit to emit light. The pixel unit operates in a number of time events repeating in sequence.

5 Claims, 5 Drawing Sheets

PIXEL UNIT STRUCTURE OF ORGANIC LIGHT EMITTING DIODE DISPLAY PANEL AND DRIVING MECHANISM THEREOF

CROSS-REFERENCE TO RELATED APPLICATIONS

This application is a divisional application of U.S. Ser. No. 14/812,546, filed Jul. 29, 2015 the contents of which are hereby incorporated by reference. The patent application Ser. No. 14/812,546 in turn claims the benefit of priority under 35 USC 119 from Taiwanese Patent Application No. 103141080 filed on Nov. 26, 2014.

FIELD

The subject matter herein generally relates to organic light emitting diode (OLED) display panels, and more particularly to an OLED pixel unit structure and driving means of the OLED pixel unit.

BACKGROUND

Generally, organic light emitting diodes (OLED) used in OLED display panels are classified as active matrix OLEDs (AMOLEDs) or passive matrix OLEDs (PMOLEDs). AMOLED display panels may include a driving transistor and a storage capacitor. The storage capacitor stores a data signal. The driving transistor provides a driving current to the OLED to emit light according to the data signal stored in the storage capacitor.

BRIEF DESCRIPTION OF THE DRAWINGS

Implementations of the present technology will now be described, by way of example only, with reference to the attached figures.

DETAILED DESCRIPTION

Figure 1:
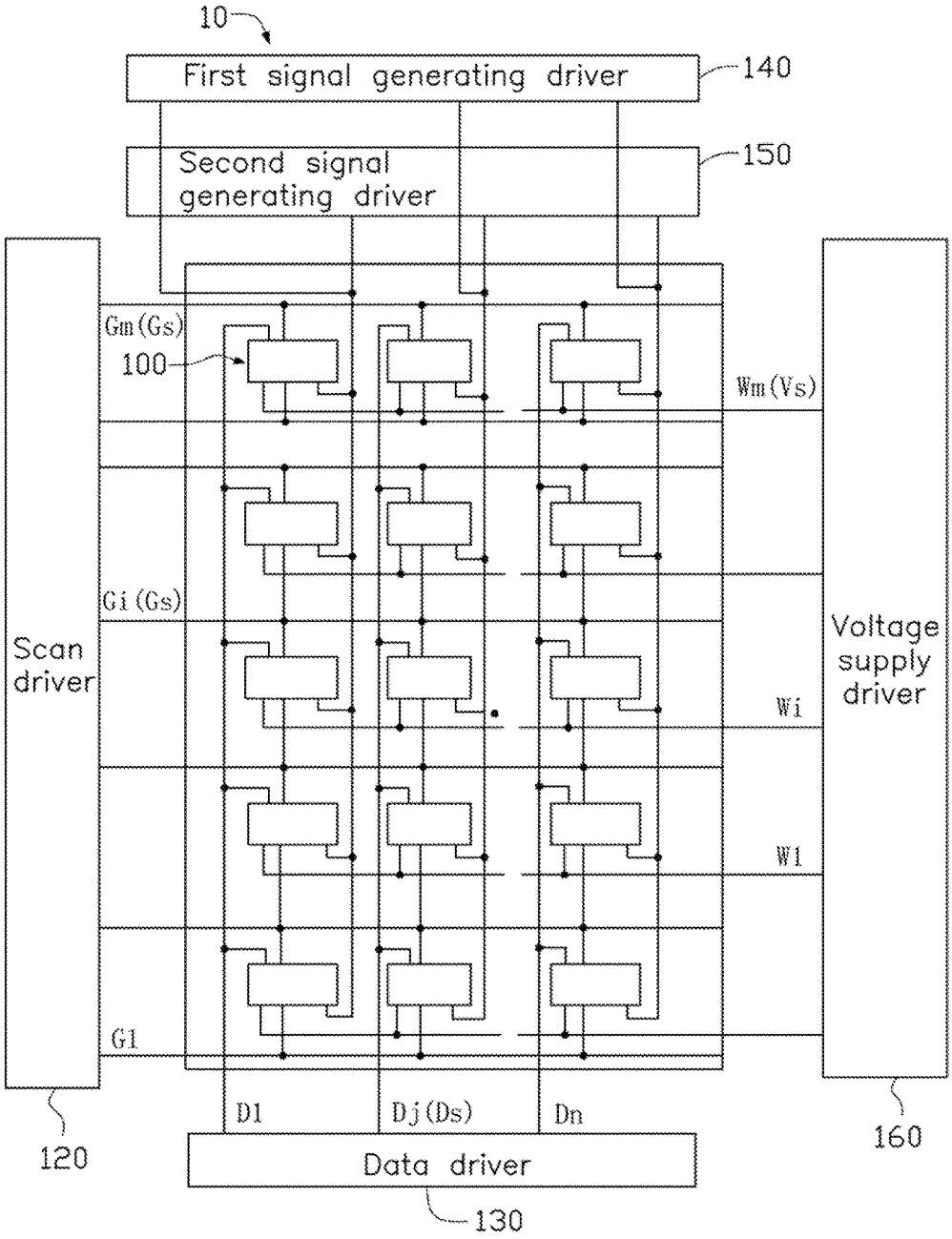
FIG. 1 is a circuit diagram of an embodiment of an organic light emitting diode display panel.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates an embodiment of a structure of an electronic display panel 10. In at least one embodiment, the electronic display panel 10 is an organic light emitting diode (OLED) display panel. The electronic display panel 10 can include a scan driver 120, a data driver 130, a first signal generating driver 140, a second signal generating driver 150, a voltage supply driver 160, and a plurality of pixel units 100. Each pixel unit 100 can be electrically coupled to the scan driver 120, the data driver 130, the first signal generating driver 140, the second signal generating driver 150, and the voltage supply driver 160 to receive corresponding signals. Each pixel unit 100 can operate in a plurality of time events repeating in sequence to improve a display quality of the electronic display panel 10.

A plurality of scan lines G1-Gm can extend from the scan driver 120. The scan driver 120 can generate scan signals Gs, and each scan line G1-Gm can transmit the scan signals Gs to corresponding pixel units 100 arranged along the scan line. A plurality of data lines D1-Dn can extend from the data driver 130. The data driver 130 can generate data signals Ds, and each data line D1-Dn can transmit the data signals Ds to corresponding pixel units 100 arranged along the data line. A plurality of first control signal lines (not labeled) can extend from the first signal generating driver 140. The first signal generating driver 140 can generate first control signals S1 (shown in FIG. 2), and each first control signal line can transmit the first control signals S1 to corresponding pixel units 100 arranged along the first control signal line. A plurality of second control signal lines (not labeled) can extend from the second signal generating driver 150. The second signal generating driver 150 can generate second control signals S2 (shown in FIG. 2), and each second control signal line can transmit the second control signals S2 to corresponding pixel units 100 arranged along the second control signal line. A plurality of voltage lines W1-Wm can extend from the voltage supply driver 160. The voltage supply driver 160 can generate voltage signals Vs, and each voltage line can transmit the voltage signals Vs to corresponding pixel units 100 arranged along the voltage line.

Figure 2:
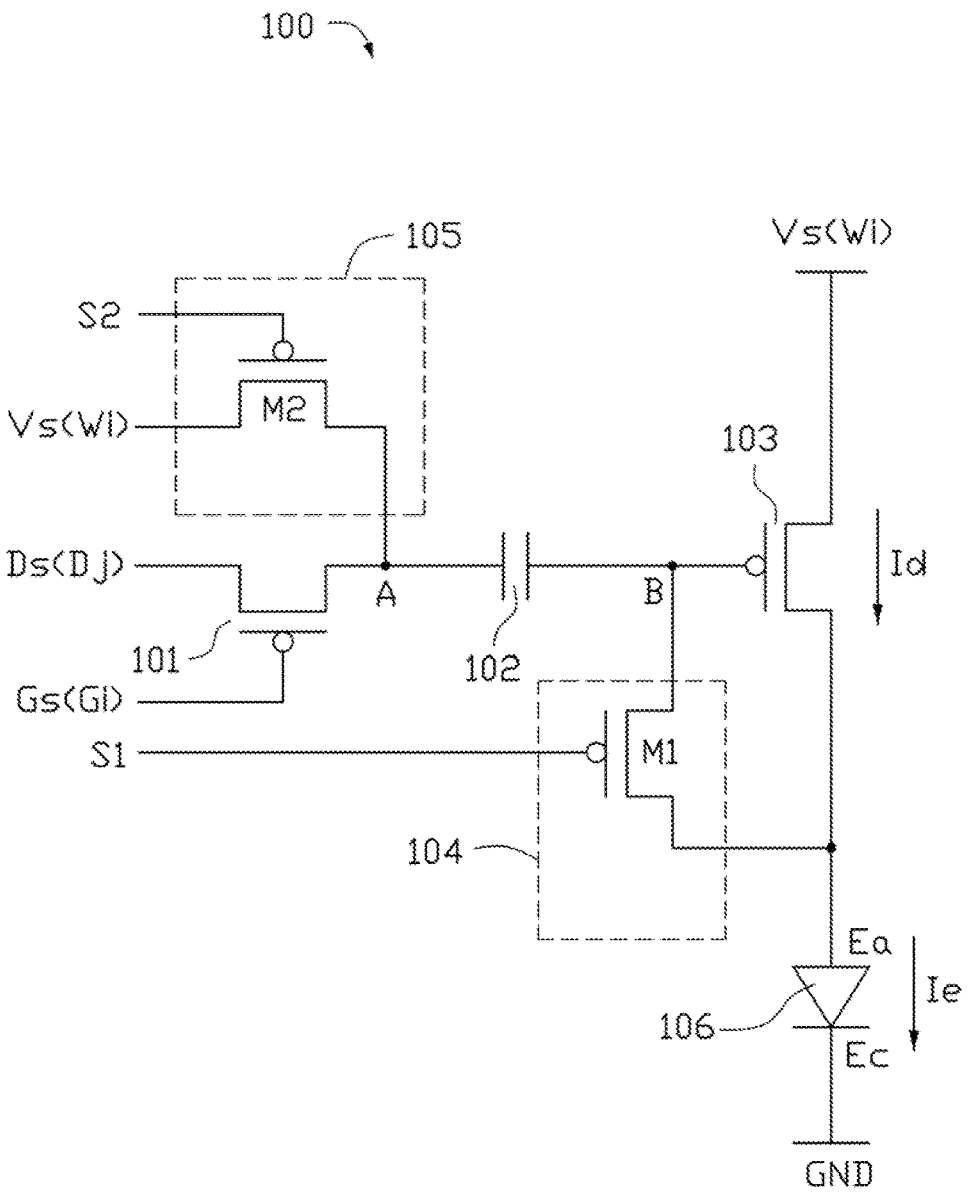
FIG. 2 is a circuit diagram of a first embodiment of a pixel unit structure of FIG. 1.

FIG. 2 illustrates a first embodiment of a structure of each pixel unit 100. Each pixel unit 100 can include a switch transistor 101, a storage capacitor 102, a driving transistor 103, a first control circuit 104, a second control circuit 105, and an organic light emitting diode (OLED) 106. The switch transistor 101 can be electrically coupled to the corresponding scan line Gi and the corresponding data line Dj to receive the scan signal Gs and the data signal Ds, respectively. The storage capacitor 102 can receive the data signal Ds from the switch transistor 101. The driving transistor 103 is electrically coupled to the corresponding voltage supply line Wi to receive the voltage signal Vs and can output a driving current Id to drive the OLED 106 to emit light corresponding to the data signal Ds. The first control circuit 104 is electrically coupled to the corresponding first control signal line to receive the first control signal S1 to cause the driving transistor 103 to be in a conducting state. The second control circuit 105 is electrically coupled to the corresponding voltage line Wi to receive the voltage signal Vs, and electrically coupled to the corresponding second control signal line to receive the second control signal S2 to relay the voltage signal Vs to the storage capacitor 102.

The OLED 106 can include an anode terminal Ea and a cathode terminal Ec. The anode terminal Ea can be electrically coupled to the driving transistor 103 and the first control circuit 104, and the cathode terminal Ec can be electrically coupled to ground Gnd.

A gate electrode of the switch transistor 101 can be electrically coupled to the scan line Gi to receive the scan signal Gs A source electrode of the switch transistor 101 can be electrically coupled to the data line Dj to receive the data signal Ds. A drain electrode of the switch transistor 101 can be electrically coupled to the storage capacitor 102 to relay the data signal Ds to the storage capacitor 102.

The storage capacitor 102 can include a first connecting terminal A and a second connecting terminal B. The first connecting terminal A can be electrically coupled to the drain electrode of the switch transistor 101 and electrically coupled to the second control circuit 105. The second connecting terminal B can be electrically coupled to the driving transistor 103 and the first control circuit 104.

A gate electrode of the driving transistor 103 can be electrically coupled to the second connecting terminal B of the storage capacitor 102. A source electrode of the driving transistor 103 can be electrically coupled to the voltage line Wi to receive the voltage signal Vs. A drain electrode of the driving transistor 103 can be electrically coupled to the first control circuit 104 and the OLED 106.

The first control circuit 104 can include a first control transistor M1. A gate electrode of the first control transistor M1 can be electrically coupled to the first control signal line to receive the first control signal S1. A source electrode of the first control transistor M1 can be electrically coupled to the second connecting terminal B of the storage capacitor 102. A drain electrode of the first control transistor M1 can be electrically coupled to the drain electrode of the driving transistor 103. When the first control transistor M1 receives the first control signal S1 to be in a conducting state, the gate electrode and the drain electrode of the driving transistor 103 are electrically coupled together to become a diode-connected transistor. When the first control transistor M1 is in a non-conducting state, the gate electrode and the drain electrode of the driving transistor 103 are electrically uncoupled from each other.

The second control circuit 105 can include a second control transistor M2. A gate electrode of the second control transistor M2 can be electrically coupled to the second control signal line to receive the second control signal S2. A source electrode of the second control transistor M2 can be electrically coupled to the voltage line Wi to receive the voltage signal Vs. A drain electrode of the second control transistor M2 can be electrically coupled to the first connecting terminal A of the storage capacitor 102. When the second control signal S2 causes the second control transistor M2 to be in a conducting state, the second control transistor M2 can relay the voltage signal Vs to the first connecting terminal A to make a voltage of the first connecting terminal A equal to the voltage of the voltage signal Vs.

In at least one embodiment, the switch transistor 101, the driving transistor 103, the first control transistor M1, and the second control transistor M2 are P-channel metal oxide semiconductors. The switch transistor 101 is in a conducting state upon receiving the scan signal Gs at a low voltage level, and in a non-conducting state upon receiving the scan signal Gs at a high-voltage level. The first control transistor M1 is in a conducting state upon receiving the first control signal S1 at a low voltage level, and in a non-conducting state upon receiving the first control signal S1 at a high-voltage level. The second control transistor M2 is in a conducting state upon receiving the second control signal S2 at a low voltage level, and in a non-conducting state upon receiving the second control signal S2 at a high voltage level.

Figure 3:
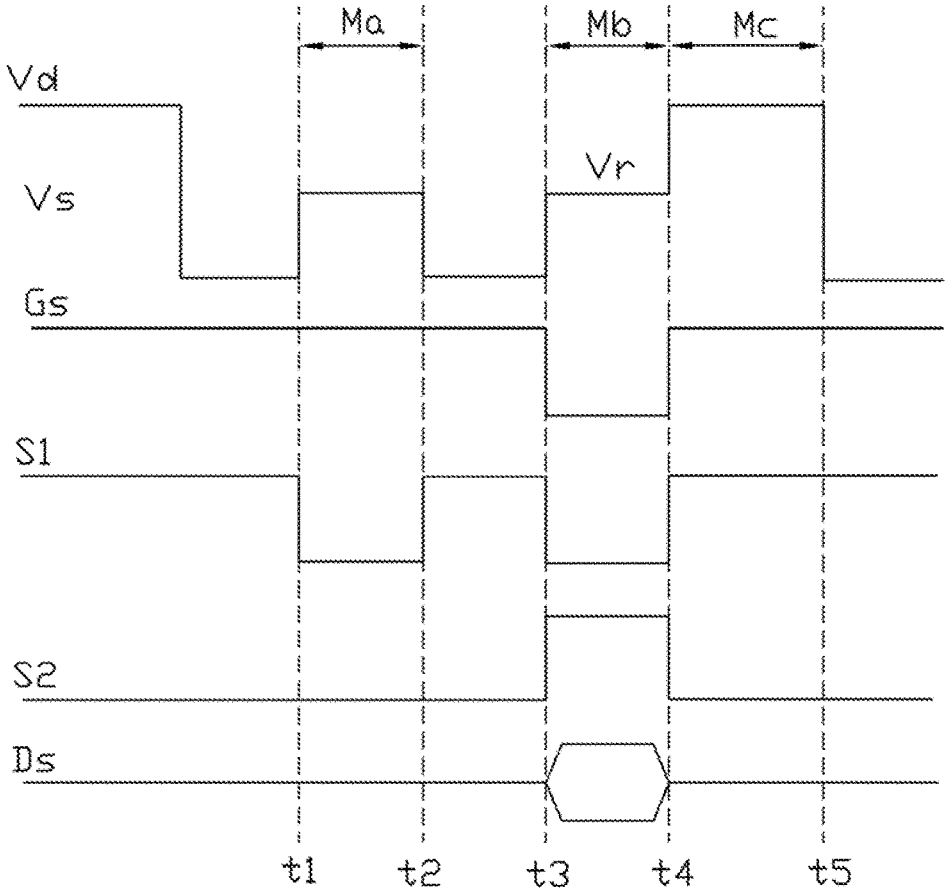
FIG. 3 is a driving sequence diagram of the pixel unit structure of FIG. 2.

Referring to FIG. 3, the plurality of time events of each pixel unit 100 can include five time events.

At a first time event t1, the first control transistor M1 receives the first control signal S1 at the low voltage level to be in the conducting state, the second control transistor M2 receives the second control signal S2 at the low voltage level to be in the conducting state, and the voltage signal Vs is received by the second control transistor M2 as the reference voltage Vr. A time period between the first time event t1 and a second time event t2 is a discharge event Ma. During the discharge event Ma, the second connecting terminal B is electrically coupled to the drain electrode of the first control transistor M1. The reference voltage Vr is relayed from the second control transistor M2 to the first connecting terminal A to make the voltage of the first connecting terminal A equal to the reference voltage Vr. Thus, a conductive path is cooperatively formed by the first connecting terminal A, the second connecting terminal B, and the first control transistor M1. Electric charge in the storage capacitor 102 can be discharged through the conductive path. The discharge of the electric charge through the conductive path can ensure more accurate storage of the data signal Ds in the storage capacitor 102.

At the second time event t2, the first control transistor M1 receives the first control signal S1 at the high voltage level to be in the non-conducting state. The voltage signal Vs is changed from the reference voltage Vr to the low voltage level.

At a third time event t3, the switch transistor 101 receives the scan signal Gs at the low voltage level to be in the conducting state, the first control transistor M1 receives the first control signal S1 at the low voltage level to be in the conducting state, and the voltage signal Vs is changed from the low voltage level to the reference voltage Vr. A time period between the third time event t3 and a fourth time event t4 is a data loading event Mb. During the data loading event Mb, the data signal Ds is relayed from the switch transistor 101 to the first connecting terminal A to make the voltage of the first connecting terminal A equal to a voltage of the data signal Ds (i.e., Vds). A voltage of the second connecting terminal B is equal to the difference between the reference voltage Vr and a threshold voltage Vth of the driving transistor 103 (i.e., Vr−Vth). Thus, a voltage difference between the first connecting terminal A and the second connecting terminal B of the storage capacitor 102 is equal to (Vds−(Vr−Vth)). The threshold voltage Vth is equal to the minimum voltage required for the driving transistor 103 to transition from the non-conducting state to the conducting state.

At the fourth time event t4, the switch transistor 101 receives the scan signal Gs at the high voltage level to be in the non-conducting state, the first control transistor M1 receives the first control signal S1 at the high voltage level to be in the non-conducting state, the second control transistor M2 receives the second control signal S2 at the low voltage level to be in the conducting state, and the voltage signal Vs is changed from the reference voltage Vr to the driving voltage Vd. A time period between the fourth time event t4 and a fifth time event t5 is a display event Mc.

During the display event Mc, the second control transistor M2 in the conducting state relays the driving voltage Vd to the first connecting terminal A to make the voltage of the first connecting terminal A equal to the driving voltage Vd, thereby making the voltage of the second connecting terminal B equal to (Vd−(Vds−(Vr−Vth))), or (Vd−Vds+Vr−Vth). The driving transistor 103 is controlled by the voltage of the second connecting terminal B to be in the conducting state, and the driving voltage Vd received by the source electrode of the driving transistor 103 causes the driving transistor 103 to output a driving current Id to the OLED 106. The OLED 106 can emit light corresponding to the data signal Ds upon receiving the driving current Id. A current Ie flowing through the OLED 106 is directly proportional to $(Vsg-Vth)^2$, wherein Vsg represents the voltage difference between the source electrode and the gate electrode of the driving transistor 103. Because the voltage of the source electrode is equal to the driving voltage Vd and the gate electrode receives the voltage of the second connecting terminal B, Vsg is equal to (Vd−(Vd−Vds+Vr−Vth), or (−Vr+Vds+Vth). Thus, the current flowing through the OLED 106 is directly proportional to $(Vds-Vr)^2$.

At the fifth time event t5, the voltage signal Vs is changed from the driving voltage Vd to the low voltage level.

Figure 4:
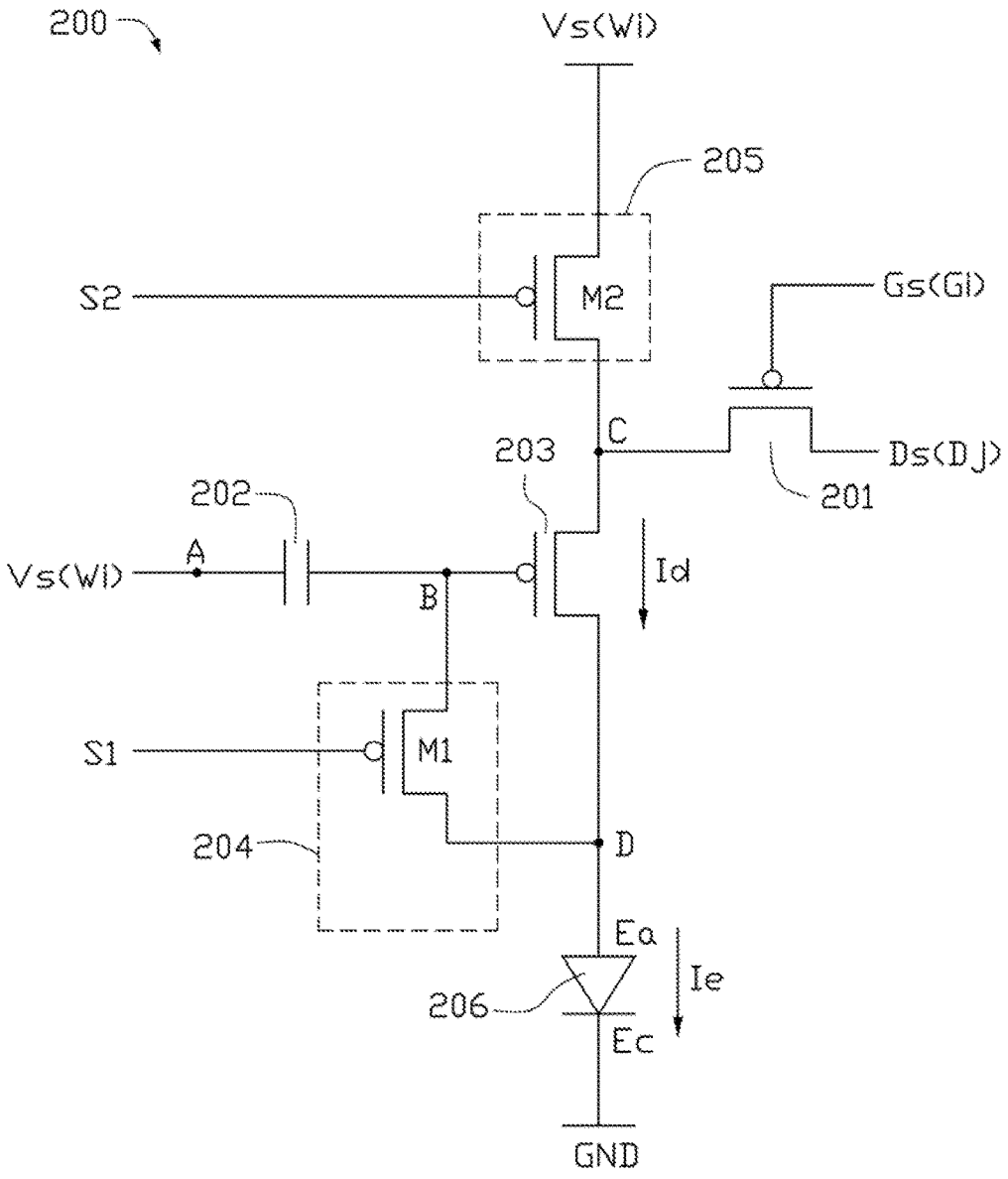
FIG. 4 is a circuit diagram of a second embodiment of a pixel unit structure of FIG. 1.

FIG. 4 illustrates a second embodiment of a structure of a pixel unit 200. In the second embodiment, each pixel unit 200 can include a switch transistor 201, a storage capacitor 202, a driving transistor 203, a first control circuit 204, a second control circuit 205, and an OLED 206. The switch transistor 201 can be electrically coupled to the corresponding scan line Gi to receive the scan signal Gs, and electrically coupled to the corresponding data line Dj to receive the data signal Ds. The driving transistor 203 can receive the data signal Ds from the switch transistor 201 and transmit a driving current Id to the OLED 206. The storage capacitor 202 can be electrically coupled to the corresponding voltage line Wi to receive the voltage signal Vs. The first control circuit 204 can be electrically coupled to the corresponding first control signal line to receive the first control signal S1 to cause the driving transistor 203 to be in a conducting state. The second control circuit 205 can be electrically coupled to the corresponding voltage line Wi to receive the voltage signal Vs, and electrically coupled to the corresponding second control signal line to receive the second control signal S2 to relay the voltage signal Vs to the driving transistor 203.

The OLED 206 can include an anode terminal Ea and a cathode terminal Ec. The anode terminal Ea can be electrically coupled to the driving transistor 203 and the first control circuit 204. The cathode terminal Ec can be electrically coupled to ground GND.

A gate electrode of the switch transistor 201 can be electrically coupled to the scan line Gi to receive the scan signal Gs. A source electrode of the switch transistor 201 can be electrically coupled to the data line Dj to receive the data signal Ds. A drain electrode of the switch transistor 201 can be electrically coupled to the driving transistor 203 to relay the data signal Ds to the driving transistor 203.

The storage capacitor 202 can include a first connecting terminal A and a second connecting terminal B. The first connecting terminal A can be electrically coupled to the voltage line Wi to receive the voltage signal Vs. The second connecting terminal B can be electrically coupled to the driving transistor 203 and the first control circuit 204.

The driving transistor 203 can include a third connecting terminal C and a fourth connecting terminal D. A gate electrode of the driving transistor 203 can be electrically coupled to the second connecting terminal B of the storage capacitor 202. A source electrode of the driving transistor 203 electrically coupled to the third connecting terminal C can be electrically coupled to the drain electrode of the switch transistor 201 to receive the data signal Ds. A drain electrode of the driving transistor 203 electrically coupled to the fourth connecting terminal D can be electrically coupled to the OLED 206.

The first control circuit 204 can include a first control transistor M1. A gate electrode of the first control transistor M1 can be electrically coupled to the first control signal line to receive the first control signal S1. A source electrode of the first control transistor M1 can be electrically coupled to the second connecting terminal B of the storage capacitor 202. A drain electrode of the first control transistor M1 can be electrically coupled to the fourth connecting terminal D. When the first control transistor M1 receives the first control signal S1 to be in a conducting state, the gate electrode and the drain electrode of the driving transistor 203 are electrically coupled together to become a diode-connected transistor. When the first control transistor M1 is in a non-conducting state, the gate electrode and the drain electrode of the driving transistor 203 are electrically uncoupled from each other.

The second control circuit 205 can include a second control transistor M2. A gate electrode of the second control transistor M2 can be electrically coupled to the second control signal line to receive the second control signal S2. A source electrode of the second control transistor M2 can be electrically coupled to the voltage line Wi to receive the voltage signal Vs. A drain electrode of the second control transistor M2 can be electrically coupled to the third connecting terminal C. When the second control signal S2 causes the second control transistor M2 to be in the conducting state, the second control transistor M2 relays the voltage signal Vs to the third connecting terminal C to make a voltage of the third connecting terminal C equal to the voltage of the voltage signal Vs.

In at least one embodiment, the switch transistor 201, the driving transistor 203, the first control transistor M1, and the second control transistor M2 are P-channel metal oxide semiconductors. The switch transistor 201 is in a conducting state upon receiving the scan signal Gs at a low voltage level, and in a non-conducting state upon receiving the scan signal Gs at a high-voltage level. The first control transistor M1 is in a conducting state upon receiving the first control signal S1 at a low voltage level, and in a non-conducting state upon receiving the first control signal S1 at a high-voltage level. The second control transistor M2 is in a conducting state upon receiving the second control signal S2 at a low voltage level, and in a non-conducting state upon receiving the second control signal S2 at a high voltage level.

Figure 5:
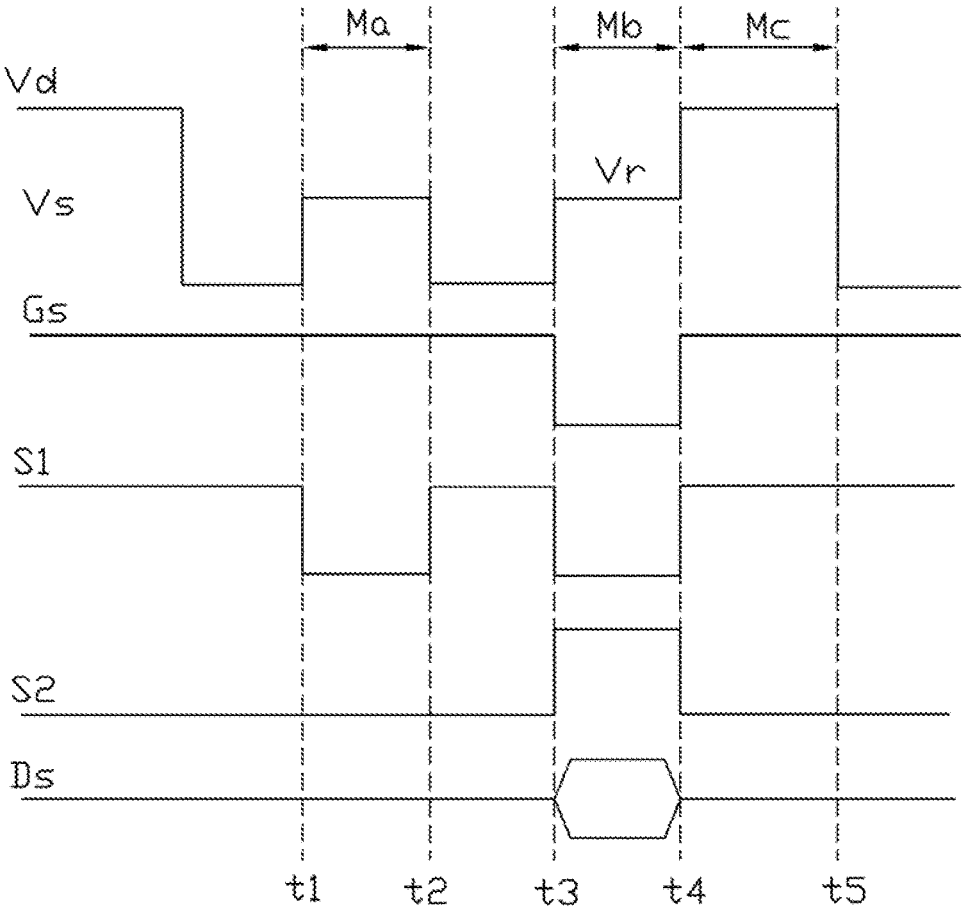
FIG. 5 is a driving sequence diagram of the pixel unit structure of FIG. 4.

Referring to FIG. 5, the plurality of time events of each pixel unit 200 can include five time events.

At a first time event t1, the first control transistor M1 receives the first control signal S1 at the low voltage level to be in the conducting state, the second control transistor M2 receives the second control signal S2 at the low voltage level to be in the conducting state, and the voltage signal Vs is received by the second control transistor M2 as the reference voltage Vr. A time period between the first time event t1 and a second time event t2 is a discharge event Ma. During the discharge event Ma, the second connecting terminal B is electrically coupled to the drain electrode of the first control transistor M1. The reference voltage Vr is relayed from the second control transistor M2 to the first connecting terminal A to make the voltage of the first connecting terminal A equal to the reference voltage Vr. Thus, a conductive path is cooperatively formed by the first connecting terminal A, the second connecting terminal B, and the first control transistor M1. Electric charge in the storage capacitor 202 can be discharged through the conductive path. The discharge of the electric charge through the conductive path can ensure more accurate storage of the data signal Ds in the storage capacitor 202.

At the second time event t2, the first control transistor M1 receives the first control signal S1 at the high voltage level to be in the non-conducting state, and the voltage signal Vs is changed from the reference voltage Vr to the low voltage level.

At a third time event t3, the switch transistor 201 receives the scan signal Gs at the low voltage level to be in the conducting state, the first control transistor M1 receives the first control signal S1 at the low voltage level to be in the conducting state, and the voltage signal Vs is changed from the low voltage level to the reference voltage Vr. A time period between the third time event t3 and a fourth time event t4 is a data loading event Mb. During the data loading event Mb, the data signal Ds is relayed from the switch transistor 201 to the third connecting terminal C to make the voltage of the third connecting terminal C equal to a voltage of the data signal Ds (i.e., Vds). A voltage of the second connecting terminal B is equal to the difference between the voltage of the data signal Ds and a threshold voltage Vth of the driving transistor 203 (i.e., Vds−Vth). Thus, a voltage difference between the first connecting terminal A and the second connecting terminal B of the storage capacitor 202 is equal to (Vr−(Vds−Vth)). The threshold voltage Vth is equal to the minimum voltage required for the driving transistor 203 to transition from the non-conducting state to the conducting state.

At the fourth time event t4, the switch transistor 201 receives the scan signal Gs at the high voltage level to be in the non-conducting state, the first control transistor M1 receives the first control signal S1 at the high voltage level to be in the non-conducting state, the second control transistor M2 receives the second control signal S2 at the low voltage level to be in the conducting state, and the voltage signal Vs is changed from the reference voltage Vr to the driving voltage Vd. A time period between the fourth time event t4 and a fifth time event t5 is a display event Mc. During the display event Mc, the second control transistor M2 in the conducting state relays the driving voltage Vd to the third connecting terminal C to make the voltage of the third connecting terminal C equal to the driving voltage Vd. The voltage of the first connecting terminal A is equal to the reference voltage Vr. Thus, the voltage of the second connecting terminal B equal to (Vd−(Vr−(Vds−Vth))), or (Vd−Vr+Vds−Vth). The driving transistor 203 is controlled by the voltage of the second connecting terminal B to be in the conducting state, and the driving voltage Vd received by the source electrode of the driving transistor 203 causes the driving transistor 203 to output a driving current Id to the OLED 206. The OLED 206 can emit light corresponding to the data signal Ds upon receiving the driving current Id. A current Ie flowing through the OLED 206 is directly proportional to $(Vsg-Vth)^2$, wherein Vsg represents the voltage difference between the source electrode and the gate electrode of the driving transistor 203 (i.e., the voltage difference between the third connecting terminal C and the second connecting terminal B). Because the source electrode receives the driving voltage Vd and the gate electrode receives the voltage of the second connecting terminal B, Vsg is equal to (Vd−(Vd−Vr+Vds−Vth), or (Vr−Vds+Vth). Thus, the current flowing through the OLED 206 is directly proportional to $(Vr-Vds)^2$.

At the fifth time event t5, the voltage signal Vs is changed from the driving voltage Vd to the low voltage level.

For the first and second embodiments of the pixel units 100 and 200, the time events t1-t5 repeat in sequence for each pixel unit 100 and 200, thereby ensuring accurate storage of the data signals Ds. The current Ie flowing through the OLED 106, 206 is related to the voltage of the data signal Ds and the reference voltage Vr, so the current Ie flowing through the OLED 106, 206 is not fluctuated by the threshold voltage Vth or the driving voltage Vd of the driving transistor 103, 203. Furthermore, the reference voltage Vr supplied by the voltage supply driver 160 to different pixel units 100, 200 is the same, so even when the driving voltage Vd supplied to the pixel units 100, 200 fluctuates, an image display quality of the electronic display panel 10 is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A pixel unit structure of an organic light emitting diode display panel, the pixel unit structure comprising:

a switch transistor configured to receive a scan signal from a scan driver, and receive a data signal from a data driver;

an organic light emitting diode configured to emit light corresponding to the data signal;

a driving transistor electrically coupled to and located between the switch transistor and the organic light emitting diode, the driving transistor configured to receive the data signal from the switch transistor and output a driving current to the organic light emitting diode;

a storage capacitor configured to receive a voltage signal from a voltage supply driver;

a first control circuit configured to receive a first control signal from a first signal generating driver; and a second control circuit configured to receive the voltage signal from the voltage supply driver, and receive a second control signal from a second signal generating driver;

wherein the organic light emitting diode is controlled by the driving transistor and the first control circuit to emit light;

wherein a voltage level of the voltage signal is one of a low voltage level, a reference voltage higher than the low voltage level, and a driving voltage higher than the reference voltage; and wherein the pixel unit operates in a plurality of time events repeating in sequence;

wherein the organic light emitting diode comprises an anode terminal electrically coupled to the driving transistor and the first control circuit, and a cathode terminal electrically coupled to ground;

a gate electrode of the switch transistor is electrically coupled to a scan line to receive the scan signal from the scan driver;

a source electrode of the switch transistor is electrically coupled to a data line to receive the data signal from the data driver;

a drain electrode of the switch transistor is electrically coupled to the driving transistor to relay the data signal to the driving transistor;

the storage capacitor comprises a first connecting terminal electrically coupled to a voltage line to receive the voltage signal from the voltage supply driver, and comprises a second connecting terminal electrically coupled to the driving transistor and the first control circuit;

the driving transistor comprises a third connecting terminal and a fourth connecting terminal;

a gate electrode of the driving transistor is electrically coupled to the second connecting terminal of the storage capacitor;

a source electrode of the driving transistor electrically coupled to the third connecting terminal is electrically coupled to the drain electrode of the switch transistor to receive the data signal;

a drain electrode of the driving transistor electrically coupled to the fourth connecting terminal is electrically coupled to the organic light emitting diode;

wherein the first control circuit comprises a first control transistor;

a gate electrode of the first control transistor is electrically coupled to a first control signal line to receive the first control signal from the first signal generating driver;

a source electrode of the first control transistor is electrically coupled to the second connecting terminal of the storage capacitor;

a drain electrode of the first control transistor is electrically coupled to the fourth connecting terminal;

the gate electrode of the driving transistor and the drain electrode of the driving transistor are electrically coupled together to become a diode-connected transistor when the first control transistor is in a conducting state;

the gate electrode of the driving transistor and the drain electrode of the driving transistor are electrically uncoupled from each other when the first control transistor is in a non-conducting state;

wherein the switch transistor, the driving transistor, the first control transistor, and the second control transistor are P-channel metal oxide semiconductors;

the switch transistor is in a conducting state upon receiving the scan signal at a low voltage level, and in a non-conducting state upon receiving the scan signal at a high-voltage level;

the first control transistor is in a conducting state upon receiving the first control signal at a low voltage level, and in a non-conducting state upon receiving the first control signal at a high-voltage level;

the second control transistor is in a conducting state upon receiving the second control signal at a low voltage level, and in a non-conducting state upon receiving the second control signal at a high voltage level; and the scan signal, the first control signal, and the second control signal control the pixel unit to operate in five time events repeating in sequence;

wherein at a first time event:

the first control transistor is in the conducting state;

the second connecting terminal is electrically coupled to the drain electrode of the first control transistor;

the first connecting terminal receives the voltage signal as the reference voltage, and a voltage of the first connecting terminal is equal to the reference voltage; and electric charge in the storage capacitor is discharged through a conduction path formed by the first connecting terminal, the second connecting terminal, and the first control transistor.

2. The pixel unit structure as in claim 1, wherein at a second time event:

the first control transistor is in the non-conducting state; and the voltage signal is changed from the reference voltage to the low voltage level.

3. The pixel unit structure as in claim 2, wherein at a third time event:

the switch transistor is in the conducting state;

the switch transistor in the conducting state receives the data signal;

the switch transistor relays the data signal to the third connecting terminal to make the voltage of the third connecting terminal equal to the voltage of the data signal;

the first control transistor is in the conducting state;

the voltage signal is changed from the low voltage level to the reference voltage; and a voltage of the second connecting terminal is equal to the difference between the voltage of the data signal and a threshold voltage of the driving transistor.

4. The pixel unit structure as in claim 3, wherein at a fourth time event:

the switch transistor is in the non-conducting state;

the first control transistor is in the non-conducting state;

the second control transistor is in the conducting state;

the voltage signal is changed from the reference voltage to the driving voltage;

the second control transistor relays the driving voltage to the third connecting terminal to make the voltage of the third connecting terminal equal to the driving voltage;

the voltage of the first connecting terminal is equal to the reference voltage;

the voltage of the second connecting terminal is equal to the sum of the difference between the driving voltage and the reference voltage and the difference between the voltage of the data signal and the threshold voltage of the driving transistor;

the driving transistor is controlled by the voltage of the second connecting terminal to be in the conducting state;

the driving transistor in the conducting state is driven by the driving voltage to output the driving current to the organic light emitting diode;

the light emitting diode, upon receiving the driving current, emits light; and a current passing through the organic light emitting diode is directly proportional to the square of the difference between the reference voltage and the voltage of the data signal.

5. The pixel unit structure as in claim 4, wherein at a fifth time event:

the voltage signal is changed from the driving voltage to the low voltage level; and the organic light emitting diode stops emitting light.

* * * * *